US005373596A

United States Patent [19]

Harrell

[11] Patent Number: 5,373,596

[45] Date of Patent: Dec. 20, 1994

[54] SHOE STRETCHING DEVICE

[76] Inventor: John W. Harrell, Rte. 1, Box 3800, Stigler, Okla. 74462

[21] Appl. No.: 143,651

[22] Filed: Nov. 1, 1993

[51] Int. Cl.[5] ..... A43D 95/02

[52] U.S. Cl. ..... 12/115.4; 12/114.2; 12/115.2

[58] Field of Search ..... 12/115.4, 115.2, 115.6, 12/117.4, 114.2

[56] References Cited

U.S. PATENT DOCUMENTS

| | | | |
|---|---|---|---|
| 729,228 | 5/1903 | Skinner | 12/117.4 |
| 1,711,091 | 4/1929 | Godsho | 12/115.2 |
| 1,862,600 | 6/1932 | Long | 12/115.4 |
| 2,983,936 | 5/1961 | Weiblen | 12/115.4 |

FOREIGN PATENT DOCUMENTS

| | | | |
|---|---|---|---|
| 497901 | 1/1951 | Belgium | 12/115.4 |
| 13150 | 2/1911 | France | 12/115.4 |
| 762742 | 4/1934 | France | 12/115.4 |
| 275878 | 6/1914 | Germany | 12/115.4 |
| 21086 | 10/1914 | United Kingdom | 12/115.4 |
| 139442 | 3/1920 | United Kingdom | 12/115.4 |

*Primary Examiner*—Steven N. Meyers
*Attorney, Agent, or Firm*—Hugh E. Smith

[57] ABSTRACT

A shoe stretching device comprising in combination a first tool component having a handle element, the handle element having a first end and a second end, an interconnecting element having a first end and a second end, the first end of the interconnecting element being integral with the second end of the handle element, a head element having a first end and a second end, the first end of the handle element being integral with the second end of the interconnecting element a convex leather stretching element connected to the second end of the head element of the first tool component a second tool component having a handle element, the handle element having a first end and a second end, a interconnecting element having a first end and a second end, the first end of the interconnecting element being integral with the second end of the handle element, a head element having a first end and a second end, the first end of the handle element being integral with the second end of the interconnecting element a concave leather engaging element connected to the second end of the head element of the second tool component the interconnecting element of the first tool component being pivotally connected to the interconnecting element of the second tool component.

1 Claim, 4 Drawing Sheets

SHOE STRETCHING DEVICE

BACKGROUND OF THE INVENTION

1. Field of the Invention

The present invention relates to a pliers type tool and more particularly pertains to such a tool which is used for stretching shoes.

2. Description of the Prior Art

The use of plier type tools are know in the prior art. More specifically, plier type tools heretofore devised and utilized for the purpose of gripping and clamping are known to consist basically of familiar, expected and obvious structural configurations, notwithstanding the myriad of designs encompassed by the crowded prior art which have been developed for the fulfillment of countless objectives and requirements.

For example, U.S. Pat. No. 3,776,071 discloses a plier. The plier includes a pair of crossed arms.

U.S. Pat. No. 4,893,530 discloses a plier-type tool. The tool has the capability to automatically slidably adjust to the size of any workpiece.

U.S. Pat. No. 3,952,357 discloses a shoe stretching device. The device includes a pair of stretching members each shaped to stretch a concave area in the side of a shoe.

U.S. Pat. No. 4,060,869 discloses an apparatus for form fitting shoes and boots. The apparatus employs a heat blower to heat the area of the foot gear which needs to be enlarged. The apparatus includes means to apply pressure from the inside of the foot gear to cause the heated portion of the foot gear to expand.

U.S. Pat. No. 3,818,527 discloses a transverse shoe stretcher. The stretcher includes two form expanding members each beveled on one side and grooved on the other to receive strips of spring steel of varying lengths.

In this respect, the plier type tool according to the present invention substantially departs from the conventional concepts and designs of the prior art, and in doing so provides an apparatus primarily developed for the purpose of stretching shoes.

Therefore, it can be appreciated that there exists a continuing need for a new and improved plier type tool which can be employed in stretching shoes. In this regard, the present invention substantially fulfills this need.

SUMMARY OF THE INVENTION

In view of the foregoing disadvantages inherent in the known types of shoe stretching devices now present in the prior art, the present invention provides an improved shoe stretching device. As such, the general purpose of the present invention, which will be described subsequently in greater detail, is to provide a new and improved shoe stretching device apparatus and method which has all the advantages of the prior art shoe stretching device and none of the disadvantages.

To attain this, the present invention essentially comprises a shoe stretching device comprising in combination a first tool component having a handle element, the handle element having a first end and a second end, an interconnecting element having a first end and a second end, the interconnecting element being substantially perpendicular to the handle element, the first end of the interconnecting element being integral with the second end of the handle element, the interconnecting element having an aperture formed intermediate its first and second ends, a head element having a first end and a second end, the head element being substantially perpendicular to the interconnecting element, the first end of the handle element being integral with the second end of the interconnecting element a convex leather stretching element connected to the second end of the head element of the first tool component a second tool component having a handle element, the handle element having a first end and a second end, a interconnecting element having a first end and a second end, the interconnecting element being substantially perpendicular to the handle element, the first end of the interconnecting element being integral with the second end of the handle element, the interconnecting element having an aperture formed intermediate its first and second ends, a head element having a first end and a second end, the head element being substantially perpendicular to the interconnecting element,the first end of the handle element being integral with the second end of the interconnecting element a concave leather engaging element connected to the second end of the head element of the second tool component, the concave leather engaging element having a circular periphery with a recess located radially interiorly of the periphery a pin secured within the aperture of the interconnecting element of the first tool component and within the aperture of the interconnecting element of the second tool component, the pin serving to pivotally interconnect the first and second tool components.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is a further object of the present invention to provide a new and improved shoe stretching device which is of a durable and reliable construction.

An even further object of the present invention is to provide a new and improved shoe stretching device which is susceptible of a low cost of manufacture with regard to both materials and labor, and which accordingly is then susceptible of low prices of sale to the consuming public, thereby making such shoe stretching devices economically available to the buying public.

Still yet another object of the present invention is to provide a new and improved shoe stretching device which provides in the apparatuses and methods of the prior art some of the advantages thereof, while simultaneously overcoming some of the disadvantages normally associated therewith.

Still another object of the present invention is to provide a new and improved shoe stretching device which can stretch any portion of a user's shoe.

Yet another object of the present invention is to provide a new and improved shoe stretching device which has removable concave and convex stretching elements.

Even still another object of the present invention is to provide a new and improved shoe stretching device which employs a force sensor.

Lastly, it is an object of the invention to provide a shoe stretching device comprising in combination a first tool component having a handle element, the handle element having a first end and a second end, an interconnecting element having a first end and a second end, the first end of the interconnecting element being integral with the second end of the handle element, a head element having a first end and a second end, the first end of the handle element being integral with the Second end of the interconnecting element a convex leather stretching element connected to the second end of the head element of the first tool component a second tool component having a handle element, the handle element having a first end and a second end, a interconnecting element having a first end and a second end, the first end of the interconnecting element being integral with the second end of the handle element, a head element having a first end and a second end, the first end of the handle element being integral with the second end of the interconnecting element a concave leather engaging element connected to the second end of the head element of the second tool component the interconnecting element of the first tool component being pivotally connected to the interconnecting element of the second tool component.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
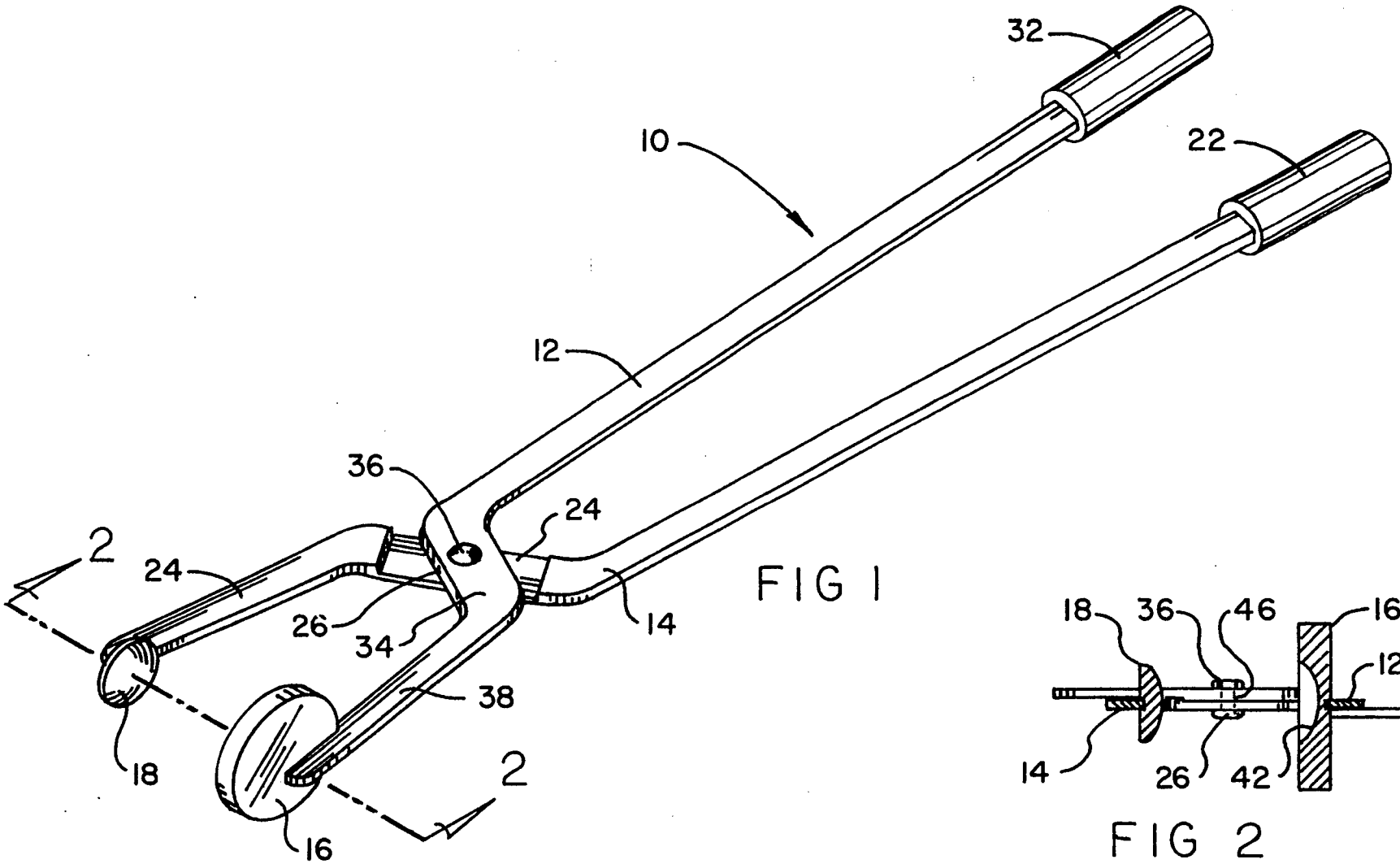
FIG. 1 is a perspective view of the first embodiment of the present invention.
FIG. 2 is a sectional view taken along line 2—2 of FIG. 1.

The present invention relates to a shoe stretching device 10. Its broadest context the device includes a first tool component 12 totally connected with a second tool component 14. The overall device is adapted to be used like a set of pliers. A concave leather receiving element 16 secured at the end of one of the components, and a convex leather stretching element 18 secured at the end of the other tool component. Thus, the device can be used in a pliers type fashion to stretch a section of shoe material.

The first tool component 14 includes a handle element 22 having a first end and a second end. The first tool component also includes an interconnecting element 24 having a first end and a second end. The interconnecting element is such that it is substantially perpendicular to the handle element. The first end of the interconnecting element is integral with the second end of the handle element. Furthermore, the interconnecting element has an aperture 26 formed intermediate its first and second ends. A head element 28 also forms part of the first tool component. The head element includes a first end and a second end. The head element is substantially perpendicular to the interconnecting element with the first end of the handle element being integral with the second end of the interconnecting element.

A convex leather stretching element 18 is connected to the second end of the head element of the first tool component. The convex leather stretching element is adapted to cooperate with a concave leather receiving element 16 as will be described in detail hereafter. Although described here as a leather stretching element the element can be employed on a variety of shoe materials such as nylon, suede or plastic.

As with the first tool component, the second tool component includes a handle element 32 which has a first end and a second end. The second tool component also includes an interconnecting element 34 which has a first end and a second end. The interconnecting element is substantially perpendicular to the handle element with the first end of the interconnecting element being integral with the second end of the handle element. The interconnecting element includes an aperture 36 formed intermediate its first and second ends. Furthermore, the second tool component includes a head element 38 which has a first end and a second end. The head element is substantially perpendicular to the interconnecting element with the first end of the handle element being integral with the second end of the interconnecting element.

Both the first and second tool components can be constructed from plastic or a light weight metal.

A concave leather engaging element 16 is connected to the second end of the head element of the second tool component. The concave leather engaging element is adapted to cooperate with the convex leather stretching element 18 of the first tool component. When the tool is in use the engaging elements serve to stretch various shoe materials. The concave element 16 is circular with an enlarged periphery with a circular recess 42 radially interiorly of the periphery. The diameter of the recess is essentially equal to that of the convex member.

A pin 46 is secured within the aperture 26 of the interconnecting element of the first tool component and within the aperture 36 of the interconnecting element of the second tool component. Thus, the pin serves to pivotally interconnect the first and second tool components.

Figures 3, 4:
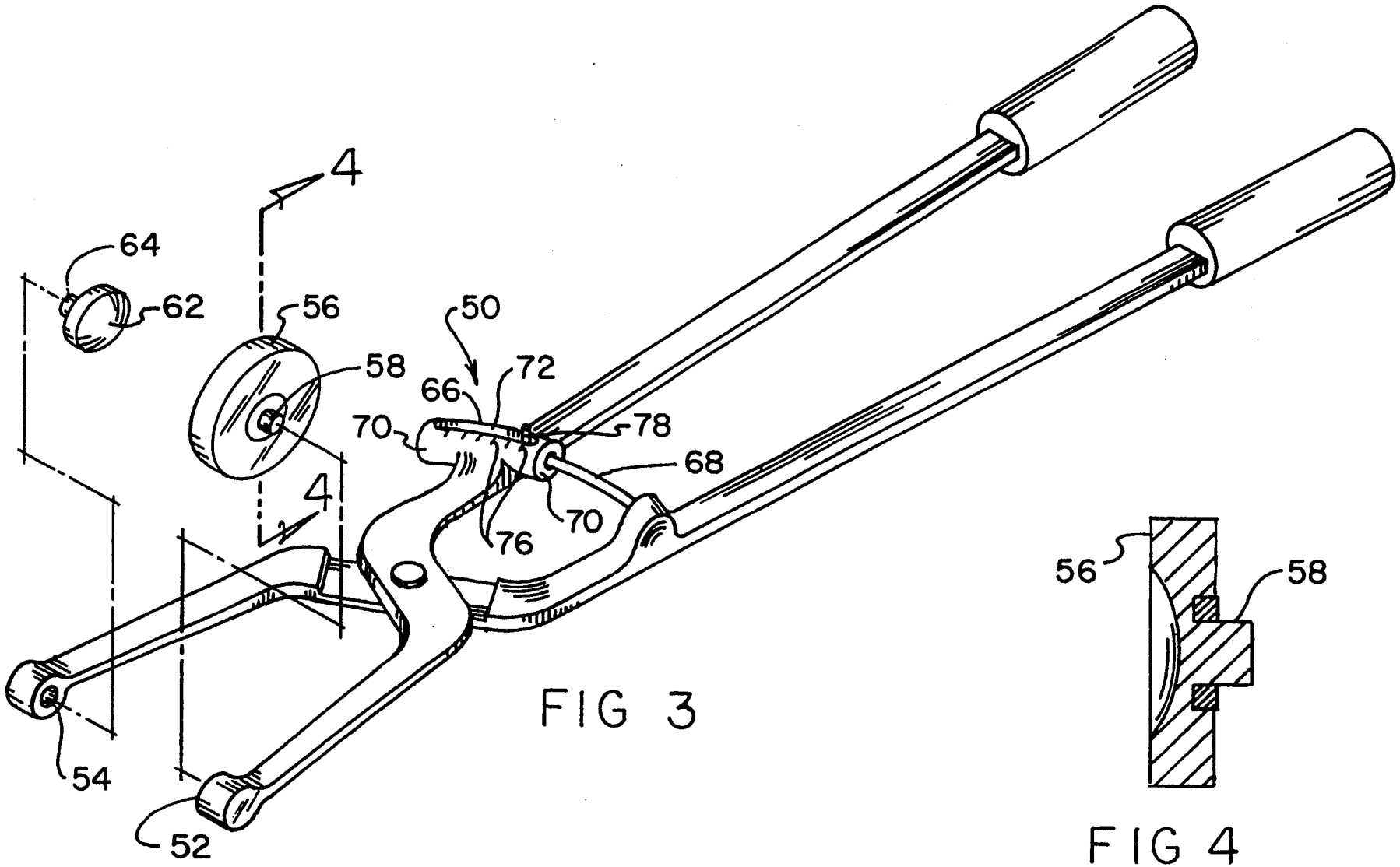
FIG. 3 is a perspective view of the second embodiment of the present invention.
FIG. 4 is a sectional view taken along FIG. 4—4 of FIG. 3.
Figure 5:
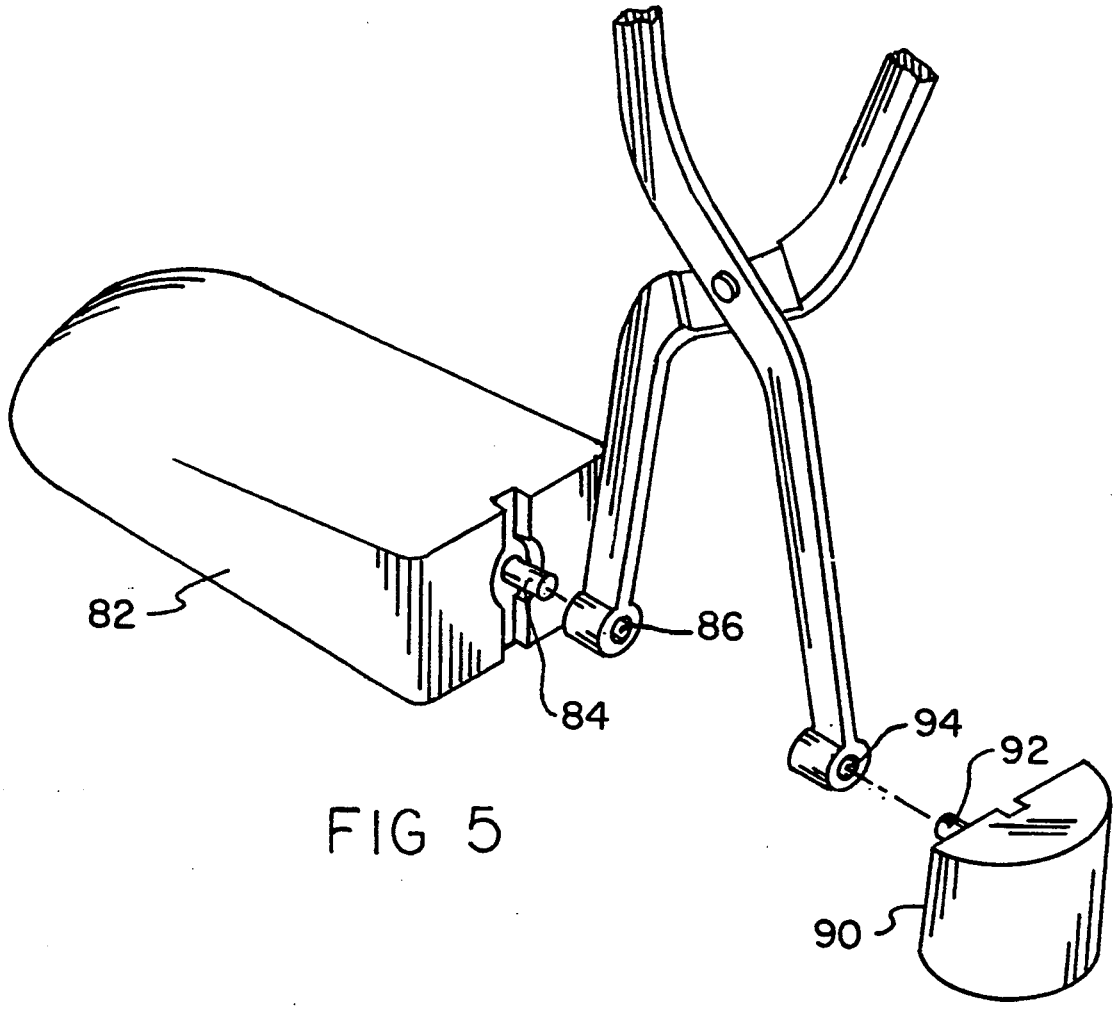
FIG. 5 is a perspective view of the third embodiment of the present invention.
Figure 6:
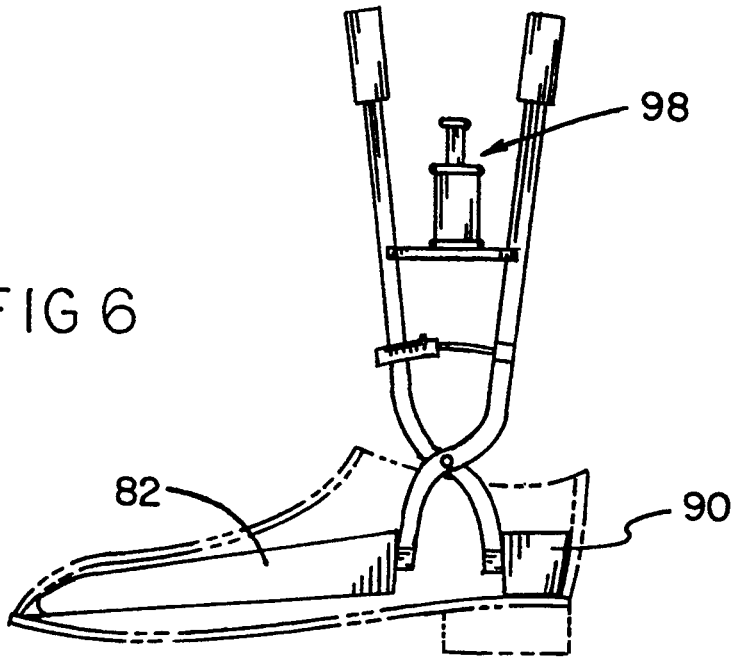
FIG. 6 is a view of the third embodiment of the present invention employing a slide hammer.
Figure 7:
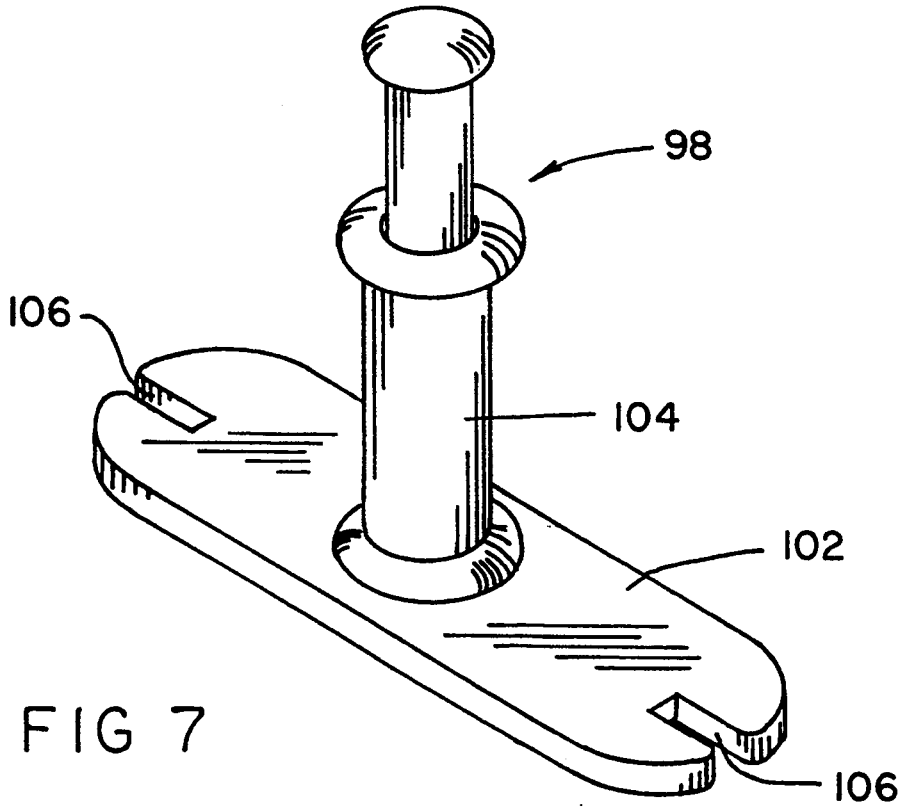
FIG. 7 is a view of the slide hammer of the present invention.
Figure 8:
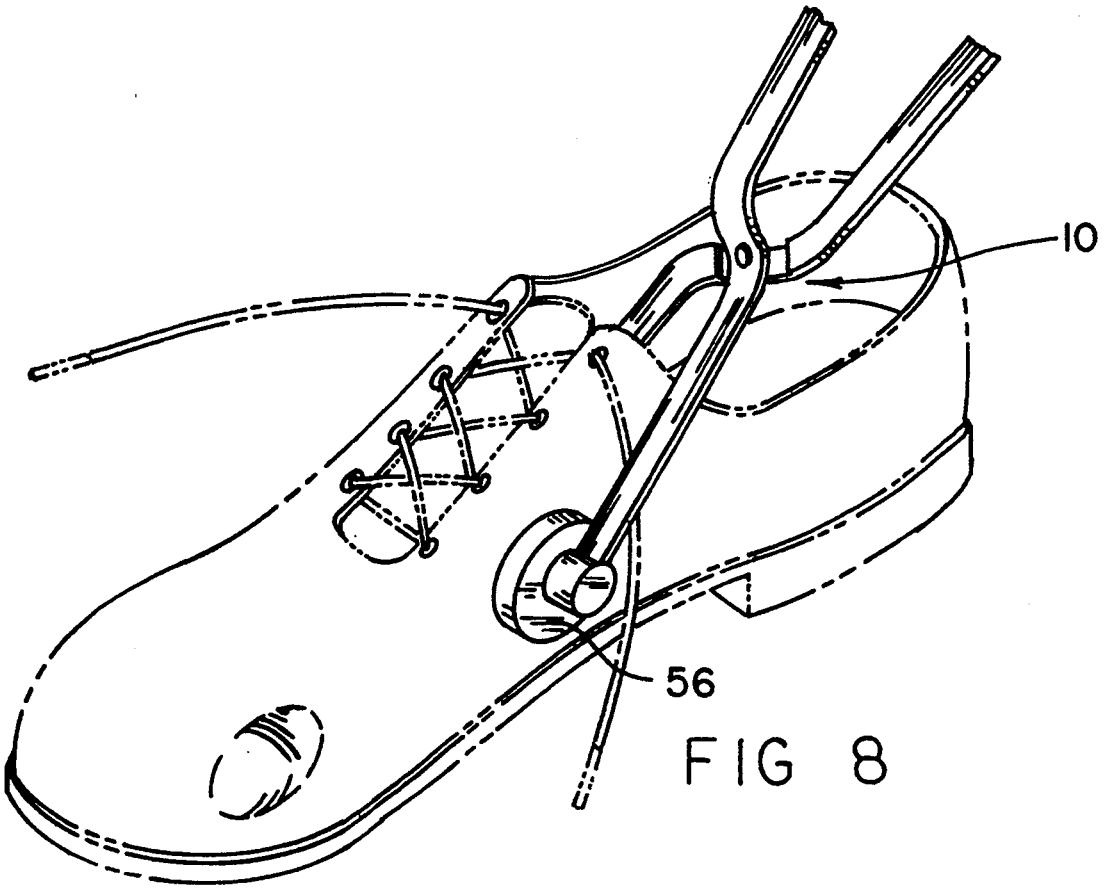
FIG. 8 is a perspective view of the first embodiment in use upon a shoe.

The shoe stretching device 50 of the second embodiment is shown in FIGS. 3 and 4 and is substantially the same as that of the first. However,in the device of the second embodiment, the second end of the head element of the first tool component includes an aperture 52. Likewise the second end of the head element of the second tool component includes an aperture 54. Furthermore, in the second embodiment, the concave leather stretching element 56 includes a pin 58 adapted to be removably secured within the aperture 52 of the head element of the first tool component.

Likewise, the convex leather engaging element 62 includes a pin 64 adapted to be removably secured within the aperture 54 of the head element of the second tool component. In this manner both the concave and the convex elements are removably secured at the ends of the head elements. The second embodiment further includes a force meter 66 integrated into the stretching device. The force meter includes a plunger 68 secured adjacent the second end of the handle of the second tool component. The force meter further includes a cylindrical housing 70 secured adjacent the second end of the handle element of the first tool component. A slot 72 is formed within the cylindrical housing 74 and markings 76 are formed along the side of the slot. The plunger of the second tool component is adapted to be inserted within the cylindrical housing of the first tool component. Thus, the cylindrical housing, the plunger, the slot, and markings together comprise the force meter.

The third embodiment is substantially the same as that of the second. However, in the third embodiment the convex leather stretching element is replaced by a first shoe horn 82 adapted to be inserted within the forward portion of a shoe. The first shoe horn includes a pin 84 adapted to be removably secured within the aperture 86 of the head element of the first tool component.

Furthermore, in the third embodiment the concave leather engaging element is replaced by a second shoe horn 90 adapted to be inserted within the rearward portion of a shoe. The second shoe horn, like the first, includes a pin 92 adapted to be removably secured within the aperture 94 of the head element of the second tool component.

Also included in the third embodiment of the present invention is a slide hammer device 98. The slide hammer includes a planar portion 102 and a vertical anvil portion 104. The planar portion includes a first end and a second end with each of the ends having an aperture 106 adapted to be placed upon one of the tool components of the stretching device.

The vertical anvil portion 104 is integral with the planar portion 102 intermediate its first and second ends. The slide hammer device 98 is adapted to be received between the first and second tool components. Furthermore, the hammer is designed to be forced downwardly by hitting the anvil portion. The downward motion of the slide hammer serving to enable greater pressure to be applied by the head elements.

The hand tool of the present invention is designed to stretch shoes. However, the innovation in this idea is that a shoe may be enlarged in any desired localizes area(s), and need not be stretched entirely as it is when using a conventional shoe tree. The tool itself broadly resembles a long pair of pliers or tongs, except that is has appropriately shaped contact points. One of the prongs has a flat circular contact pad with a shallow cavity in the center, while the other has a button-shaped protuberant which nests inside the other when the tool is forced closed. The handles are elongated so that pressure may be easily applied to the otherwise unreachable toe area of the shoe.

Hence, it can be seen that the present invention may be positioned in any number of infinite positions and the simple expedient of applying pressure will expand that area of shoe material such as leather, to provide relief for painful corns or other foot ailments. Corns, of course, grow in random locations, and the shoe stretcher addresses this problem. Simply position the tool in the proper location and apply force to the handles. The male half of the tool will force the leather, or other pliable material, into the female cavity of the other half, and causes the material to stretch and conform to the expanded shape. It is not necessary to stretch the entire shoe, to the point where it doe not fit well and is easily disengaged from the foot, to obtain relief. Instead, one may simply expand only the required area while maintaining a snug and comfortable fit in others.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shoe stretching device comprising in combination:

a first tool component having a handle element, the handle element having a first end and a second end, an interconnecting element having a first end and a second end, the first end of the interconnecting element being integral with the second end of the handle element, a head element having a first end and a second end, the first end of the handle element being integral with the second end of the interconnecting element;

a convex leather stretching element connected to the second end of the head element of the first tool component;

a second tool component having a handle element, the handle element having a first end and a second end, a interconnecting element having a first end and a second end, the first end of the interconnecting element being integral with the second end of the handle element, a head element having a first end and a second end, the first end of the handle element being integral with the second end of the interconnecting element;

a concave leather engaging element connected to the second end of the head element of the second tool component;

the interconnecting element of the first tool component being pivotally connected to the interconnect element of the second tool components;

the second end of the head element of the first tool component includes an aperture;

the second end of the head element of the second tool component includes an aperture;

the convex leather stretching element is replaceable by a first shoe horn adapted to be inserted within the forward potion of a shoe, the first shoe horn including a pin adapted to be removably secured within the aperture of the head element of the first tool component;

the concave leather engaging element is replaceable by a second shoe horn adapted to be inserted within the rearward portion of a shoe, the second shoe horn including a pin adapted to be removably secured within the aperture of the head element of the second tool component.

a slide hammer device, the slide hammer including a planar portion, the planar portion having a first end and a second end, each of the ends of the planar portion having an aperture adapted to be placed upon one of the tool components of the stretching device, the slide hammer device further including a vertical anvil portion, the vertical anvil portion being integral with the planar portion intermediate its first and second ends, the slide hammer device adapted to be received in between the first and second tool components and forced downwardly by hitting the anvil portion, the slide hammer serving to enable greater pressure to be applied by the head elements.

* * * * *